US008992236B2

(12) United States Patent
Wittig et al.

(10) Patent No.: US 8,992,236 B2
(45) Date of Patent: Mar. 31, 2015

(54) TANDEM MULTI-FORK PUSH-IN PIN

(75) Inventors: Klaus Wittig, Oehringen (DE); Werner Kallee, Bad Friedrichshall (DE)

(73) Assignee: Würth Elektronik ICS GmbH & Co KG, Niedernhall (DE)

( * ) Notice: Subject to any disclaimer, the term of this patent is extended or adjusted under 35 U.S.C. 154(b) by 0 days.

(21) Appl. No.: 14/002,705

(22) PCT Filed: Jan. 25, 2012

(86) PCT No.: PCT/EP2012/051161

§ 371 (c)(1),
(2), (4) Date: Oct. 14, 2013

(87) PCT Pub. No.: WO2012/116860

PCT Pub. Date: Sep. 7, 2012

(65) Prior Publication Data

US 2014/0045390 A1 Feb. 13, 2014

(30) Foreign Application Priority Data

Mar. 3, 2011 (DE) ..... 10 2011 005 073

(51) Int. Cl.

| | |
|---|---|
| ***H01R 12/00*** | (2006.01) |
| ***H01R 13/17*** | (2006.01) |
| ***H01R 12/58*** | (2011.01) |
| ***H01R 12/70*** | (2011.01) |
| ***H01R 43/20*** | (2006.01) |
| *H01R 12/75* | (2011.01) |
| *H01R 43/16* | (2006.01) |

(52) U.S. Cl.

CPC ..... *H01R 13/17* (2013.01); *H01R 12/585* (2013.01); *H01R 12/7088* (2013.01); *H01R 43/205* (2013.01); *H01R 12/75* (2013.01); *H01R 43/16* (2013.01)

USPC ..... 439/82; 439/825

(58) Field of Classification Search

CPC ..... H01R 13/05; H01R 9/092

USPC ..... 439/825, 862, 567, 857, 553, 660, 82

See application file for complete search history.

(56) References Cited

U.S. PATENT DOCUMENTS 3,673,551 A * 6/1972 McDonough ..... 439/853
4,231,931 A * 11/1980 Model ..... 548/460

(Continued)

FOREIGN PATENT DOCUMENTS

DE 103 25 134 A1 12/2004
WO WO 2010/063459 A1 6/2010

*Primary Examiner* — Phuongchi T Nguyen

(74) *Attorney, Agent, or Firm* — Robert A. Blaha; Smith Risley Tempel Santos LLC

(57) ABSTRACT

A connector for electrically connecting a conductor to a printed circuit board by direct plugging into respective contact holes of the printed circuit board is disclosed. The connector has a fastening region, a transmission region, four first plug-in elements, which can be inserted jointly into a first contact hole, and four second plug-in elements, which can be inserted jointly into a second contact hole. The plug-in elements extend from a main body formed from a plastically bendable electrically conductive plate, which is bent such that two of the first plug-in elements are arranged opposite two other of the first plug-in elements at least partly congruently for plugging into the first contact hole, and such that two of the second plug-in elements are arranged opposite two other of the second plug-in elements at least partly congruently for plugging into the second contact hole.

28 Claims, 6 Drawing Sheets

(56) References Cited

U.S. PATENT DOCUMENTS

| | | | | |
|---|---|---|---|---|
| 4,331,376 | A * | 5/1982 | Leather | 439/689 |
| 4,943,248 | A * | 7/1990 | Colleran et al. | 439/850 |
| 5,669,792 | A | 9/1997 | Naka et al. | |
| 6,193,567 | B1 * | 2/2001 | Hsieh | 439/853 |
| 7,175,487 | B2 * | 2/2007 | Urbaniak et al. | 439/852 |
| 2004/0038597 | A1 * | 2/2004 | Norris | 439/857 |
| 2006/0292934 | A1 | 12/2006 | Schell et al. | |
| 2008/0146088 | A1 | 6/2008 | Ader | |

* cited by examiner 1100
101
103
105
120
128
1102
1104
1104

1100
101
103
105
120
128
126
124
122
128
402
126
404
1102
1102
1104
1104

TANDEM MULTI-FORK PUSH-IN PIN

TECHNICAL FIELD

The present invention relates to a plug connector device for electrically connecting a conductor to a printed circuit board. The present invention further relates to a connection assembly comprising the plug connector device and the printed circuit board. In addition, the invention provides a plug connector semifinished product. The present invention further relates to a method of electrically connecting a conductor to a printed circuit board. In addition, the present invention relates to a vehicle and a method of use.

BACKGROUND

An assembly for electrically and mechanically connecting plug elements via a base to a printed circuit board is known, said assembly being designed for high electrical and mechanical requirements.

Connection assemblies for printed circuit boards that enable a plug-in part to be plugged directly onto a printed circuit board without a socket fastened to the printed circuit board are also known from WO 2010/063459 of the same applicant.

Although such a connection assembly has many advantages, it can be further improved in terms of the way of managing very high currents.

SUMMARY

There may be a need for a plug connection between a printed circuit board and a plug connector device suitable for very high currents.

In accordance with an exemplary embodiment of the invention, a plug connector device for electrically connecting a conductor to a printed circuit board (in particular a printed circuit board being free of sockets) by direct plugging of the plug connector device into a first contact hole and into a second contact hole of the printed circuit board is created. The plug connector device has a fastening region for fastening the conductor to the plug connector device, a transmission region for transmitting a current from the conductor to the printed circuit board, (at least) four first plug-in elements, which can be inserted jointly into the first contact hole, and (at least) four second plug-in elements, which can be inserted jointly into the second contact hole. Each of the plug-in elements extends from a common main body of the plug connector device and runs in a manner separated from the other plug-in elements. The main body is formed with the plug-in elements from a (one-piece or multi-piece and/or one-material or multi-material) plastically bendable electrically conductive (for example planar or flat) plate, which is bent such that two of the first plug-in elements are arranged opposite two other of the first plug-in elements at least partly congruently (that is to say overlapping only in part or completely congruently, in particular contacting one another) for plugging into the first plug-hole, and such that two of the second plug-in elements are arranged opposite two other of the second plug-in elements at least partly congruently (that is to say overlapping only in part or completely congruently, in particular, contacting one another) for plugging into the second contact hole.

In accordance with another exemplary embodiment, a plug connector semifinished product formed from a bendable plate (wherein the plate can be formed in one piece or of multiple pieces and/or can be formed from one material or multiple materials) for producing a plug connector device having the above-described features is provided, wherein the plug connector semifinished product can be bent along at least one bending line, in particular along at least two bending lines, such that, by bending the plug connector semifinished product, the plug connector device having the above-described features can be produced.

In accordance with yet another exemplary embodiment of the invention, a connection assembly is provided that has a plug connector device having the above-described features and a printed circuit board having the first contact hole and having the second contact hole, wherein the plug connector device is connected by a plug connection, in particular exclusively by a plug connection, to the printed circuit board.

In accordance with a further exemplary embodiment of the present invention, a method of electrically connecting a conductor to a printed circuit board by directly plugging a plug connector device into a first contact hole and into a second contact hole of the printed circuit board is provided. In the method, an electrically conductive plate of the plug connector device is bent in such a way that two of four first plug-in elements of the plug connector device are arranged opposite two other of the first plug-in elements at least partly congruently for plugging into the first contact hole, and such that two of four second plug-in elements of the plug connector device are arranged opposite two other of the second plug-in elements at least partly congruently for plugging into the second contact hole. Furthermore, the conductor is fastened to a fastening region of the plug connector device, and the four first plug-in elements of the plug connector device are inserted jointly into the first contact hole and the four second plug-in elements of the plug connector device are inserted jointly into the second contact hole so as to form a plug connection between the plug connector device and the printed circuit board. Furthermore, in the method, a current is transmitted from the conductor to the printed circuit board via a transmission region of the plug connector device.

In accordance with a further exemplary embodiment of the invention, a vehicle is provided which is equipped with a plug connector device or a connection assembly having the above-described features.

In accordance with an exemplary embodiment of the invention, an electric current can be coupled from an electrical conductor arranged on a fastening region, via a bent plate over two, in particular resilient, plug-in element pairs, into a first contact hole and at the same time via another pair of plug-in element pairs into another, second contact hole in a printed circuit board. With a device that can be produced in a very compact and, due to the simple bending of a plate, cost-effective manner, it is thus possible, by dividing a current between two ohmically coupled assemblies each formed of two double contact pairs, to transmit very high currents from 10 A to 40 A and more. This is possible by a direct plug-in technology, in which the plug connector device is plugged directly, that is to say without a socket, into the contact holes in the printed circuit board. Due to the at least partial congruence of the plug-in elements arranged one over the other in the respective contact holes, the plug connector device can additionally be manufactured with small dimensions.

DETAILED DESCRIPTION OF EXEMPLARY EMBODIMENTS

Figure 1:
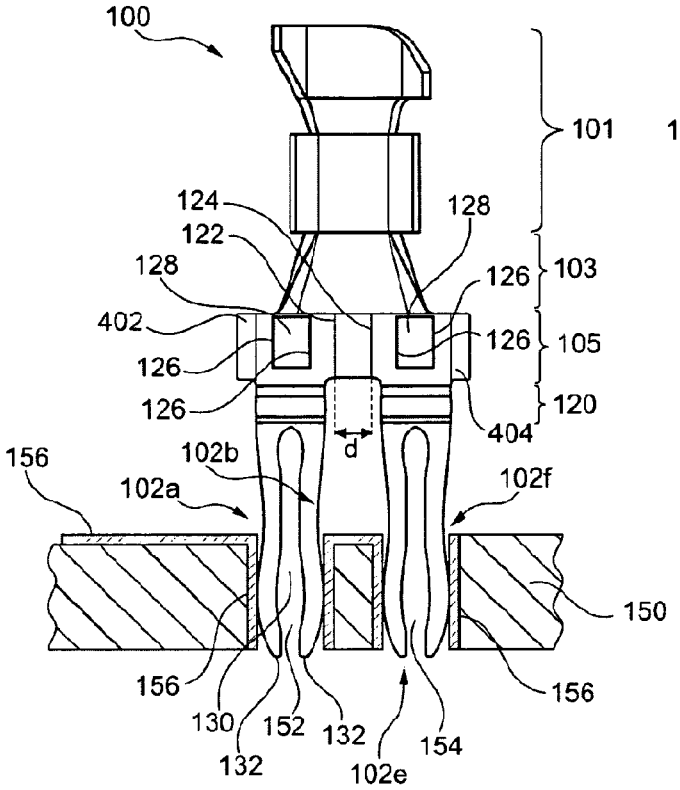
FIG. 1 shows a plug connector device according to an exemplary embodiment of the invention, which is inserted into a printed circuit board and forms a connection assembly therewith.

Embodiments of the plug connector device will be described hereinafter. These also apply for the plug connector semifinished product, for the connection assembly, for the method, for the vehicle, and for the use.

In accordance with an exemplary embodiment, bending lines, along which the plate is bent, can be aligned parallel to a direction of extension of the plug-in elements, starting from the main body. The direction of extension of the plug-in elements is defined by the largest dimension of the plug-in elements, starting from the main body. The direction of extension corresponds to the plug-in direction of the plug connector device when inserted into a printed circuit board. The bending lines may be straight axes (in particular virtual or imaginary axes) on the plate that are used as bending axes for arranging corresponding plug-in elements one over the other in an at least partly congruent manner by bending the plate. The bending lines may however also be perforated or locally thinned for example, in particular a bending line may provide a predetermined bending position, at which the plug connector semifinished product can preferably be deformed, in particular plastically.

In accordance with an exemplary embodiment, the plate can be bent along two bending lines, which run parallel to one another and are each laterally offset with respect to a centre of gravity (in particular a centre of mass) of the fastening region, wherein the centre of gravity is arranged geometrically between the two bending lines. In particular, these two bending lines can be arranged symmetrically about the centre of mass of the fastening region or the centre of mass of the plate. The two bending lines are selected in such a way that the bending of part of the plate about this bending line leads to the at least partial congruence of respective plug-in element pairs. In the case of four plug-in element pairs, two respective bending lines are formed here. A third bending line can be produced by the crimping of a fastening region by bending corresponding components of the plate about this bending direction, In accordance with an exemplary embodiment, a first end region of the plate can be bent over in a U-shaped manner whereby the two of the first plug-in elements are arranged opposite the two other first plug-in elements. Furthermore, a second end region of the plate can be bent over in a U-shaped manner, whereby the two of the second plug-in elements are arranged opposite the two other second plug-in elements. A U-shaped bend corresponds substantially to a bend of a plate region through 180°, whereby a previously flat region of the plate is divided into two regions that run parallel to one another and are interspaced and are also interconnected by a U-shaped bend portion. Tandem contacts can thus be formed with little effort, more specifically in such a way that the plug connector device is stable and still thin and compact.

In accordance with an exemplary embodiment, the two bent-over end regions of the plate can be arranged opposite one another in a manner spaced from one another with their end faces aligned. In this context, the mutually aligned and opposed assembly means that the two bent-over end regions form flat end portions that are clearly directed or point towards one another, but are arranged at a predefinable distance from one another. With the exception of the separation region, a substantially annular structure is then defined by the main body and can be received in a space-saving manner in a receiving opening in a respective housing, for example made of plastic.

In accordance with an exemplary embodiment, at least one clamping strip for clamping the plug connector device in a housing can be formed (in particular separately) as part of the plate by forming at least two recess lines (in particular punch lines) in the plate. Such clamping strips serve to receive and fasten the substantially annular structure of the bent main body in a housing, for example made of plastic. By simply punching out (or other removal of material, for example by drilling, milling, laser cutting or the like) straight or curved punch lines, which may be arranged parallel to one another, a plastically bendable clamping strip is defined, which then enables the plug connector device to be fixed in a housing by a clamping force or spring force.

In accordance with an exemplary embodiment, a clamping strip may be formed on each of the two bent-over end regions of the plate, such that the two clamping strips protrude with respect to the plate in the same direction. In particular, the clamping strips may constitute mutually parallel plane portions. In accordance with this embodiment, the two clamping strips are clearly arranged in a common plane and thus ensure a fixation of the plug connector device in a housing at two positions. Since the two clamping strips are clearly arranged on the same side of the main body bent substantially annularly, the rear-face longitudinal side, that is to say the longitudinal side opposite the clamping strips, of the annularly bent main body remain free such that the fastening region, starting therefrom, can extend upwards continuously electrically conductively.

In accordance with an exemplary embodiment, the plate can be bent such that the two of the first plug-in elements are arranged opposite and contacting, in particular contacting in pairs, the two other of the first plug-in elements and such that the two of the second plug-in elements are arranged opposite and contacting the two other of the second plug-in elements. Due to such a contacting of opposed, at least partly congruent, plug-in elements, the electrically conductive connection can be formed with particularly low ohmic resistance, and at the same time the mechanical fastening effect of the plug-in elements in the respective contact hole can be further improved.

In accordance with an exemplary embodiment, the plug connector device may have an integer multiple of two plug-in elements, in particular an integer multiple of four plug-in elements, more particularly exactly eight plug-in elements. The fact that the number of plug-in elements is even ensures that pairs of plug-in elements can form a resilient contact element. The provision of the plug-in elements as a multiple formed by the number four ensures that two pairs of plug-in elements are in each case assigned to one another to form a pair of contact springs and can be inserted into a common contact hole. The provision of exactly eight plug-in elements with the plug connector device has proven to be sufficiently capable of handling high currents and sufficiently robust with respect to vibration, wherein the plug connector device can then simultaneously be formed in a very compact manner.

The plastically bendable electrically conductive plate can be formed in one piece and/or by one material. Alternatively, the plastically flexible electrically conductive plate can be composed of a number of sub-plates of different thicknesses and/or different materials (for example by a stamped connection and/or rivet connection).

In accordance with an exemplary embodiment, the fastening region can be formed as a crimpable crimp portion. In the connection assembly, the plug-in elements can be formed as crimp contacts. With a crimp connection, a stable and flexible connection that can be formed at reasonable cost with a wire or cable is enabled. Crimping or flanging is understood to mean a joining method in which two components are interconnected by plastic deformation. The crimp contacts may have a crimpable crimp portion (for fastening of a wire or cable) and an elastically pluggable portion (for direct plugging onto a printed circuit board).

In accordance with an exemplary embodiment, the crimpable crimp portion and the plug-in elements can be formed from different materials. The crimpable crimp portion and the resiliently pluggable portion (plug-in element) can be formed from different materials.

In accordance with an exemplary embodiment, the crimpable crimp portion can be formed with a thinner material thickness compared to the sum of the thicknesses of the two plug-in elements arranged oppositely, at least partly congruently. For example, the plate may then have the same thickness in the region of the crimp portion as in the region of the plug-in elements (or alternatively a different thickness). The plug-in zone is then thicker in the feedthrough of the printed circuit board for reasons of mechanical stability and current transmission.

In particular, the plate may have, in the crimpable crimp portion, a thickness in a range between approximately 0.1 mm and approximately 0.7 mm, in particular a thickness in a range between approximately 0.3 mm and approximately 0.5 mm. Alternatively or in addition, the plug-in elements arranged oppositely at least partly congruently together have a thickness in a range between approximately 0.5 mm and approximately 1.1 mm, in particular a thickness in a range between approximately 0.7 mm and approximately 0.9 mm. These dimensions allow a sufficiently lightweight configuration and additionally enable low-force crimping in the crimp region and an elastic, yet fastening, behaviour in the plug-in region. In the region of the plug-in elements, the total thickness may be between 0.7 mm and 0.9 mm. This means that this is true for the contacts folded over one another to form a double contact unit, that is to say ultimately the sum of two plate thicknesses.

It is thus possible, on the one hand due to the provision of a sufficiently thin material (for example having a thickness of 0.4 mm, for example made of bronze), to achieve a good crimp connection, and, on the other hand by a thicker material (for example having a thickness of 0.8 mm, for example made of K55 or K88), to achieve a good level of elasticity with high current-carrying capability. It is advantageous if the contact is composed of two different regions:

- a region consisting of bronze for the crimp zone with a thickness of 0.4 mm
- a region consisting of K55 or K88 for the plug-in zone with a thickness of 0.8 mm.

In accordance with an exemplary embodiment, each of the plug-in elements may have a plug-in portion, wherein the plug-in portion is the portion of the plug-in elements that is located within the respective contact hole when the plug-in elements are inserted in the respective contact hole.

The plug-in elements may be elastically deformable independently of one another with respect to the main body and may be designed in such a way that, when the plug-in elements are inserted in the respective contact hole, a plug connection between the plug connector device and the printed circuit board can be provided. Each of the plug-in elements may have a free end.

The end portion, which each of the plug-in elements has, can project for example beyond the plug-in portion of the plug-in element, such that, when the plug connector device is plugged in the contact hole, the end portion, on the opposite side of the main body, projects via the free end of the plug-in element from the respective contact hole with respect to the printed circuit board. In other words, the end portion or the free end of the plug-in element can project from the respective contact hole in the plug-in direction when the plug connector device is inserted in the contact hole.

Furthermore, each plug-in element may have an intermediate portion between the plug-in portion and the main body. In an exemplary embodiment of the invention, by the intermediate portion, the main body cannot rest directly on a surface of the printed circuit board, such that the plug-in elements comprise the intermediate portion first in the plug-in direction. The plug-in portion of the plug-in elements, which for example is terminated by the end portion of the plug-in element, then extends at the intermediate portion in the plug-in direction.

In accordance with a further exemplary embodiment, the plug-in portion comprises the transmission region at least in part. This means that the current transmission between the conductor via the plug connector device on the printed circuit board is provided via a contact between the plug-in portions and the inner surfaces of the (through-contacted) contact holes. The plug-in portion of the plug-in element can be coated for example with a conductive layer. Furthermore, the plug-in elements or also the entire plug connector device can consist of an electrically conductive material. Regions which are not intended to transmit any current can be coated with an insulating layer. Since the plug-in portion is already in contact with the inner surface of the contact hole due to the production of the plug connection or the press-fit connection, the transmission region can be provided at the same time without further constructional design.

In accordance with a further exemplary embodiment, the plug-in portion of each plug-in element has at least one convex surface. The convex surface is formed in particular on the side of the plug-in elements that is aligned in the direction of the inner surface of the contact holes when the plug-in elements are plugged in. Due to the convex design of a surface of the plug-in portions, the contact area between the plug-in element and the inner surface of the respective contact hole can be reduced. The force (pressure force, spring force) can thus be concentrated onto a smaller region, specifically onto a region that is in contact with the inner surface of the contact hole due to the convex curvature. Due to the concentration of the contact region, the contact pressure increases, such that a more stable press fit connection can be provided.

In accordance with a further exemplary embodiment, at least two of the four plug-in elements per contact hole abut against one another, at least in part. Due to the abutment of two plug-in elements, these can support and stabilise one another, such that a higher mechanical load-bearing capacity can be provided. In spite of the abutment of two plug-in elements, these can still be freely movable in the further directions and can spread apart at different points in the contact hole.

In accordance with a further exemplary embodiment, at least two plug-in elements are spaced by a gap. The plug-in elements which are separated by a gap can deform elastically in the direction of the gap. The plug-in elements can thus deform elastically in the direction of the gap as they are inserted into the respective contact hole, such that the plug connector device can be inserted into the contact hole by the plug-in elements.

The plug-in elements form limbs so to speak that leave free a gap therebetween. The outer faces facing away from one another of the plug-in elements may optionally be curved convexly for example. Due to such a curvature, an undesirable spreading of the limbs in the event of contact with a planar surface can be avoided. With use of fork contacts, a possibility for elastic plugging can be achieved.

In accordance with a further exemplary embodiment, the main body has a stop region. The stop region is designed in such a way that an insertion of the plug-in elements into the respective contact hole can be delimited by the stop region. The stop region for example prevents a further insertion of the plug connector device in the plug-in direction. The stop region can be produced for example by a protrusion or a convexity on the main body, such that the main body with the stop region has a larger diameter than the contact hole, for example. The cross section with the stop region therefore cannot be passed through the contact hole, such that a stop can be provided automatically. The stop region may also be formed on at least one plug-in element, in particular in the intermediate region or intermediate portion of the plug-in element. It is thus dispensable for the main body to abut against a surface of the printed circuit board, but merely the stop region of one of the plug-in elements. Such a stop region as a positioning aid can make it intuitively easier for a user to correctly plug together the plug-in element and printed circuit board and to thus avoid electrical malfunctions. The stop region is thus used to delimit the insertion of the plug connector device into the printed circuit board. The stop region or spacer may define a minimum spacing between the printed circuit board and plug connector device, and for example may thus prevent the formation of undesirable electrical contact or the sparking of an electrical signal via a thin gap.

The elastic deformability of the plug-in elements can also be achieved if at least two of the three plug-in elements have a gap between one another, wherein these plug-in elements can deform elastically in the direction of the gap. Due to a return force against the gap direction, the plug-in elements can then be pressed against an inner surface of the respective contact hole, such that a press-fit connection can be provided.

In accordance with a further embodiment, the distance between at least two plug-in elements along their directions of extension is not constant.

In accordance with a further exemplary embodiment, the end of each plug-in element has a rounded surface. A wedging of each plug-in element when inserted into the contact hole can thus be eliminated, since a rounded surface can find its way into the contact hole in a self-guiding manner, for example.

In accordance with a further exemplary embodiment, at least one plug-in element has a widening at an end portion. Here, the end portion comprises the free end of the plug-in element and protrudes from the contact hole in the plug-in direction when the plug-in element is inserted in the contact hole. The widening is formed on the end portion in such a way that the widening wedges or jams with a surface of the printed circuit board when the plug-in element is inserted in the respective contact hole. The widening can be formed as a protrusion and may form an undercut, which extends substantially perpendicular to the plug-in direction. In other words, the widening (undercut) may extend parallel to a surface plane of the printed circuit board and may thus be substantially perpendicular to the inner surface of the contact hole. The widening can thus prevent a movement of the plug connector device against the plug-in direction, since the widening bears against a surface of the printed circuit board and thus prevents a further movement of the plug-in element against the plug-in direction. The plug-in elements for example may be pressed together during the insertion into the contact hole, such that the cross section of all plug-in elements inclusive of the widening has a smaller diameter than the respective contact hole. When the plug-in elements are inserted into the contact hole, the plug-in elements move back into the starting position due to their elastic deformability, such that the press-fit connection between the plug-in elements and the contact hole can be formed. In a plugged-in state of the plug connector device in the respective contact hole, the main body or in particular the shoulder is normally arranged on a surface side of the printed circuit board. On the opposite surface of the printed circuit board, the plug-in elements can protrude via their end portions from the respective contact hole. In these end portions, the widening is formed, which wedges or jams with this surface of the printed circuit board so as to thus prevent a release of the plug connector device against the plug-in direction.

In accordance with an exemplary embodiment, the plug connector device may be formed from a single punched and bent electrically conductive plate. In this embodiment, the plug connector device can be formed with very low production cost, since no further components apart from a metal plate or the like are necessary. The semifinished product or the finished plug connector device can be produced integrally from a single piece of sheet metal by punching and bending. Such an integral embodiment of the plug element from one sheet metal piece leads to particularly low costs. Alternatively, a plug element may also be formed from a number of components however, for example in order to integrate further functions.

In accordance with an exemplary embodiment, at least one of the first plug-in elements and/or at least one of the second plug-in elements may have a locking mechanism, in particular a barbed locking mechanism, which is designed to lock the plug connector device to the printed circuit board when the plug connector device is guided through the respective contact hole. In other words, it may be sufficient to plug the plug connector device through the contact holes in the printed circuit board, whereby the locking mechanism on one or more of the plug-in elements is locked automatically, that is to say without the intervention of a user, to the printed circuit board. This enables a high level of user comfort and a plug connection that is robust with respect to vibration.

In accordance with an exemplary embodiment, the locking mechanism may be designed to unlock the plug connector device again from the printed circuit board when the plug-in elements are pressed together and the plug connector device is removed from the contact holes. A simple unlocking procedure can thus be enabled by a course of movements inverse compared to the locking procedure, that is to say pressing together of the plug-in elements and subsequent removal of the plug connector device from the printed circuit board. Such a locking mechanism may have a reversible characteristic, that is to say it may be unlocked and locked basically as often as desired. This can be achieved by a locking and unlocking characteristic that is not based on a plastic deformation of the plug-in elements, and instead elastically deforms the plug-in elements during the locking and unlocking procedures.

In accordance with an exemplary embodiment, a first of the first plug-in elements and a first of the second plug-in elements may consist of the plug-in portion located within the respective contact hole when the respective plug-in elements are inserted in the respective contact hole. A second of the first plug-in elements and a second of the second plug-in elements may comprise the plug-in portion located within the respective contact hole when the plug-in elements are inserted in the respective contact hole, and comprises an arc-shaped portion that extends from the plug-in portion and back through the respective contact hole as far as the plug-in portion of the first of the respective plug-in elements and is separated therefrom by a gap. The size of the gap can be reduced initially during the process of plugging the plug connector device into the printed circuit board and can be enlarged again once the arc-shaped portion has exited from the printed circuit board. The first and the second plug-in elements may form a cooperating pair. Due to the arc-shaped portion, the plug connector device can be prevented from becoming caught as it is plugged into a printed circuit board. Furthermore, the combination of the two plug-in elements ensures both reversible locking and stable anchoring of the plug connector device in a contact hole in a printed circuit board.

In accordance with an exemplary embodiment, an end region of the arc-shaped portion can be guided resiliently through the contact hole when inserted into the printed circuit board and, once guided through the contact hole, can spring back, whereby the plug connector device can be locked to the printed circuit board by the end region. Whilst the arc-shaped portion is guided through the contact hole, it is compressed inwardly by a lateral delimitation of the contact hole. Once the arc-shaped portion has exited from the printed circuit board, this compressive force disappears, such that the arc-shaped portion can spring back outwardly, thus ensuring the locking effect.

In accordance with an exemplary embodiment, a concave region of the arc-shaped portion may be arranged adjacently to a convex region of the plug-in portion of the first of the plug-in elements, in particular at a distance therefrom. The first plug-in element can be formed as a convex arc. A corresponding concave region of the arc-shaped portion is arranged in relation to the convex first plug-in portion such that these regions are prevented from catching on one another and can slide against one another.

The terms "convex" and "concave" relate to surface regions of the plug connector device acting outwardly, in particular to surface regions of the plug connector device that face towards a contact hole wall as the plug connector device is inserted into a contact hole in a printed circuit board plate.

In accordance with an exemplary embodiment, the arc-shaped portion may have two mutually opposed elongate regions, which are interconnected by a curved arc that is arranged opposite the plug-in portions of the first and second of the plug-in elements. The two elongate regions and the arc connecting them form substantially a U-shape. The spring effect and also the mechanically stabilising effect of the second plug-in element are thus enabled. Furthermore, the arc shape prevents the plug connector device from becoming caught as it is inserted into the respective contact hole.

In accordance with an exemplary embodiment, in the plug connector device, further plug-in elements can be formed such that they are configured partly similarly to the first plug-in element and partly similarly to the second plug-in element. The above embodiments of the first and second plug-in element therefore apply similarly for these plug-in elements.

With the above-described embodiments, a contact element with a fork press and a self-locking function is created. A corresponding plug connector device can be used in many technical fields, for example in the automotive sector, in the industry sector, in the computer sector, and as a telecommunications plug. With a plug connector device according to an exemplary embodiment, fuses, plug connectors, relays, capacitors, resistors, varistors, etc. can be plugged directly into a printed circuit board and can be locked to any contact element by a self-locking mechanism. The connection can be released by a simple aid or even by hand.

In the connection assembly, the printed circuit board can be provided with a first electrically conductive contacting layer in the first contact hole and with a second electrically conductive contacting layer in the second contact hole. These contacting layers may be metal structured layers on the printed circuit board formed for example from plastic (for example FR4, with glass fibre mats saturated with epoxy resin) and provided with the contact holes.

The first electrically conductive contacting layer and the second electrically conductive contacting layer can be coupled to one another electrically. A common electric supply signal or useful signal can then be transmitted from the conductor to both (or also more than two) contact holes.

The plug connector device may contact the printed circuit board in the contact hole by the electrically conductive contacting layer in a solder-free manner. A reliable and continuous electrical coupling can thus be achieved merely by the resilient fitting of the plug-in portions against the plating in the contact holes, without the need for a complex solder connection.

In accordance with a further exemplary embodiment, a plug assembly formed from a plug connector device having the above-described features and from a shaped tool is provided, in which the shaped tool is designed to press together the plug connector device locked to the printed circuit board, whereby the plug connector device locked to the printed circuit board is unlocked. Locking by barbs on the one hand ensures a secure hold, but on the other hand can also be released again. The possibility for release can be achieved using a corresponding shaped tool which is fitted over and in so doing deforms the barb(s) to such an extent that a locked effect is no longer provided.

By the elastic deformation of the plug-in elements, it is possible for the plug connection (for example the press-fit connection) to be provided in such a way that a greater force is necessary to remove the plug connector device from the contact hole than to plug it into the contact hole. Furthermore, a possibility for plugging in or removing the plug connector device "by hand" can thus be provided. A possibility for plugging in and removing the plug element "by hand" can be understood in particular within the scope of this description to mean that the plug-in and removal forces, even with the provision of a plurality of plug-in elements, are sufficiently low such that they can be applied by the muscular power of an average adult human user. The plug connector device can be plugged directly by hand by a human user into the corresponding contact holes in the printed circuit board without the need to provide a separate plug socket between the plug connector device and printed circuit board, as is the case with conventional connection assemblies capable of dealing with high current.

In accordance with an exemplary embodiment of the invention, the vehicle, for example, is a motor vehicle, a passenger car, a lorry, a bus, an off-road motor vehicle, a baler, a combine harvester, a self-propelled sprayer, a road construction machine, a tractor, an aircraft, an aeroplane, a helicopter, a spaceship, a Zeppelin, a watercraft, a ship, a rail vehicle or a train, wherein the vehicle comprises the plug connector device or the connection assembly having the above-described features.

Exemplary embodiments will be described in greater detail hereinafter with reference to the accompanying drawings in order to further explain and better understand the present invention.

Like or similar components in different figures are provided with like reference numerals.

A tandem contact according to an exemplary embodiment of the invention is a multi-fork direct plug-in contact, which couples a conductor to a plurality of contact holes of a printed circuit board in order to increase the current-carrying capacity. Due to the doubling (or general multiplication) of the contacting zone to two (or more) pins, higher currents can be transmitted (in particular 40 A to 45 A and more), yet the contact element is a one-piece punched contact that can be manufactured favourably. It may connect, for example, a crimping zone 0.4 mm thick to a contact zone 0.8 mm thick and, within a feedthrough, may have a large contact area with the printed circuit board sleeve. Cables having a cross section from 4 $mm^2$ to 6 $mm^2$ can be crimped on. The tandem multi-fork contact can be formed so as to be lockable as required. Depending on the constructional design, with regard to the locking effect, a choice can be made between a firmly locking (only releasable via a tool) connection and a plug connection releasable by hand.

FIG. 1 shows a plug connector device 100 according to an exemplary embodiment of the invention for electrically connecting an electrical conductor 302 (see FIG. 3) to a printed circuit board 150 by direct plugging of the plug connector device 100 into a first contact hole 152 and a second contact hole 154 of the printed circuit board 150. A continuously electrically conducting contacting layer 156 between the first contact hole 152 and the second contact hole 154 is formed in a planar manner on a main face of the printed circuit board 150 and also annularly in the interior of the contact holes 152, 154.

The plug connector device 100 has a fastening region 101 for fastening the conductor 302 to the plug connector device 100. Furthermore, the plug connector device 100 has a transmission region 103 for transmitting an electric current from the conductor 300 to the printed circuit board 150 or vice versa.

Figure 4:
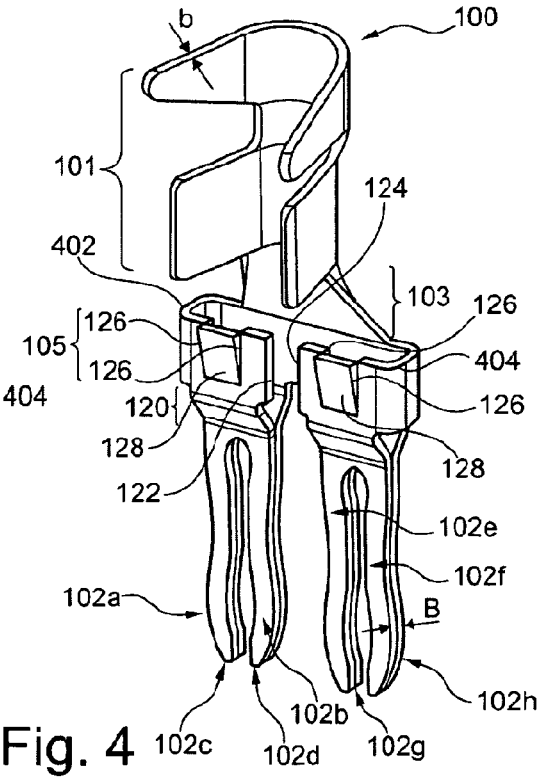
FIG. 4 shows a three-dimensional view of the plug connector device according to FIG. 1.

Four first plug-in elements 102*a* to 102*d*, of which only two can be seen in FIG. 1 and all of which can be seen in FIG. 4, are inserted jointly into the first contact hole 152. Four second plug-in elements 102*e* to 102*h*, of which only two can be seen in FIG. 1 and all of which can be seen in FIG. 4, are inserted jointly into the second contact hole 154. Each of the plug-in elements 102*a* to 102*h* extends from a common main body 105 of the plug connector device 100 and runs separated from the other plug-in elements 102*a* to 102*h* up to a free end.

Figure 5:
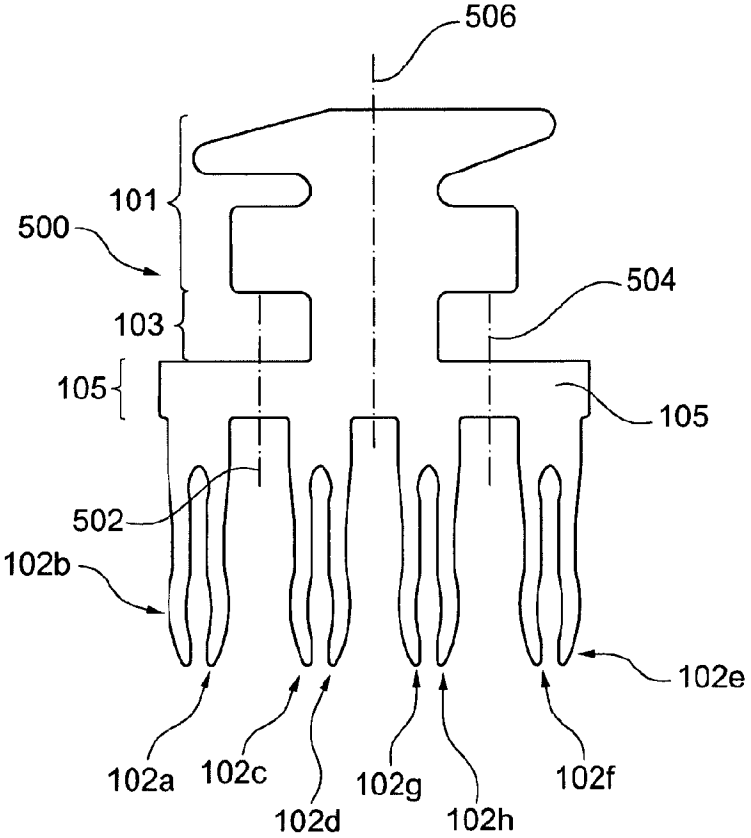
FIG. 5 shows a plug connector semifinished product according to an exemplary embodiment of the invention, which, by bending about bending lines shown in FIG. 5, can be used to form a plug connector device according to FIG. 1.

As can be seen with reference to the plug connector semi-finished product 500 shown in FIG. 5 for forming the plug connector device 100, the main body 105 and the plug-in element 102*a* to 102*h* are formed from a plastically flexible electrically conductive metal plate. This metal plate is bent such that the plug-in elements 102*a* and 102*b* are arranged opposite the plug-in elements 102*c* and 102*d* completely congruently and in a contact-based manner (see FIG. 2) for plugging into the first contact hole 152. Accordingly, the plug-in elements 102*e* and 102*f* are arranged opposite the two other plug-in elements 102*g* and 102*h* completely congruently and in a contacted manner for plugging into the second contact hole 154.

FIG. 5 shows a first bending line 502, a second bending line 504, and a third bending line 506, about which the plug connector semifinished product 500 formed as a punched sheet metal plate is bent in order to produce the plug connector device 100. FIG. 5 shows that the bending lines 502, 504, which are bent so as to form, respectively, a first tandem contact 102*a* to 102*d* and a second tandem contact 102*e* to 102*h*, are aligned parallel to a direction of extension of the plug-in elements 102*a* to 102*h* (a vertical direction in accordance with FIG. 5), starting from the main body 105. The two bending lines 502 and 504 run parallel to one another and are offset laterally with respect to a centre of mass of the fastening region 101, which is arranged over the third bending line 506, such that the centre of mass and the third bending line 506 are arranged between the first bending line 502 and the second bending line 504. FIG. 5 also shows that the assembly has a high degree of symmetry, which advantageously also leads to a high degree of symmetry with respect to the current flow along the plug connector device 100.

FIG. 4 most clearly shows that a region of the end region of the plates arranged to the left of the bending line 502 according to FIG. 5 is bent over inwardly in a U-shaped manner, whereby the plug-in elements 102*a*, 102*b* are arranged opposite the plug-in elements 102*c*, 102*d*. Accordingly, a region of the plate arranged on the right-hand side of the second bending line 504 according to FIG. 5 is likewise bent over inwardly in a U-shaped manner, whereby the plug-in elements 102*e*, 102*f* are arranged opposite the plug-in elements 102*g*, 102*h*. The U-shaped bending regions are denoted in FIG. 4 by reference signs 402 and 404. Furthermore, a bend is made along the third bending line 506, whereby a crimp receptacle for receiving the conductor 302, which is cylindrical in this exemplary embodiment, is formed in the fastening region 101.

Figure 2:
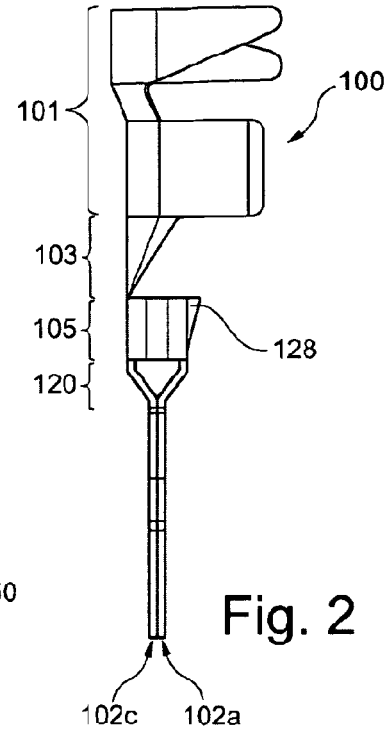
FIG. 2 shows a side view of the plug connector device according to FIG. 1.

FIG. 4 and FIG. 2 most clearly show a tapering region 120, along which a transition is made between the main body 105 and the plug-in elements 102*a* to 102*h* by bending or pressing in such a way that the plug-in elements associated with one another 102*a*, 102*c* and 102*b*, 102*d*, and also 102*e*, 102*g* and 102*f*, 102*h* can be pressed against one another so as to contact one another.

FIG. 1 and FIG. 4 further show that the two bent-over end regions of the main body 105 are arranged opposite one another, aligned to flush with one another and spaced by a spacing d from one another. The end faces of these regions are denoted by reference signs 122, 124.

Furthermore, four punch lines 126 are formed in the sheet metal, whereby two clamping strips 128 are formed on the plate. A clamping strip 128 is formed on each of the two bent-over end regions of the plate, such that the two clamping strips 128 protrude in the same direction with respect to the plate. In accordance with FIG. 1, the clamping strips 128 are folded forwards out from the plane of the sheet of paper.

It can be most clearly seen in FIG. 1 and FIG. 4 that each of the plug-in elements 102*a* to 102*h* has a plug-in portion, which is the portion located within the respective contact hole 152, 154. The plug-in elements 102*a* to 102*h* are elastically deformable independently of one another with respect to the main body 105 and are designed such that, when the plug-in elements 102*a* to 102*h* are inserted in the contact hole 152 or 154, a plug connection is produced between the plug connector device 100 and the printed circuit board 150. The plug-in portions of the plug-in elements 102*a* to 102*h* have a convex surface. Plug-in elements arranged opposite one another in an axially symmetrical manner so as to form a spring pair (for example plug-in element 102*a* and plug-in element 102*b*) are separated from one another by a gap 130 and have three ends 132.

FIG. 4 also shows that the thickness b of the plate in the crimp region is less than the sum of the individual thicknesses (overall thickness B) of the plug-in elements 102*g*, 102*h* (or of two other plug-in elements contacting one another). With constant plate thickness, B=2b.

Figure 6:
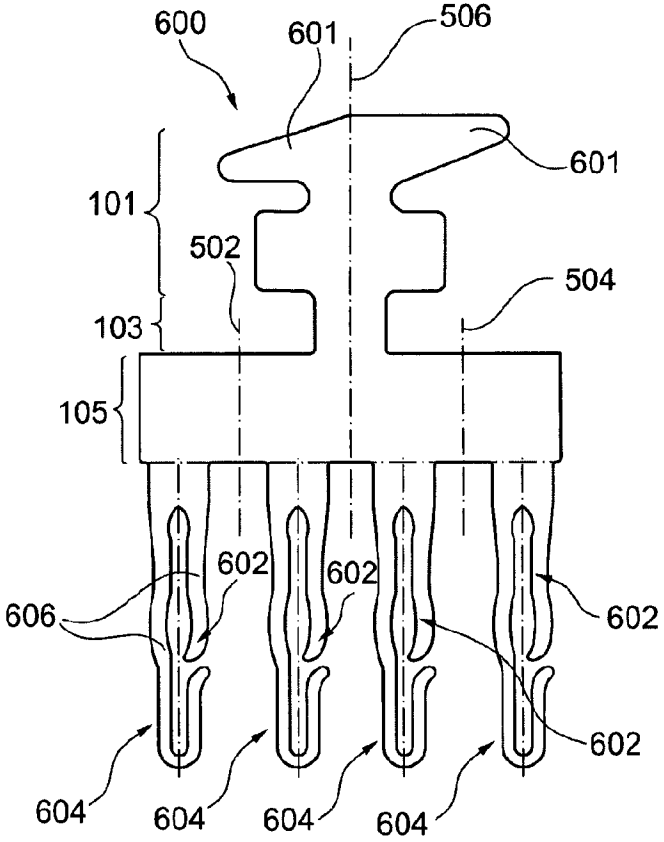
FIG. 6 shows a plug connector semifinished product in accordance with another exemplary embodiment of the invention, which, by bending about bending lines shown in FIG. 6, can be used to form a plug connector device according to another exemplary embodiment of the invention.

A plug connector semifinished product 600 shown in FIG. 6 as a basis for producing a plug connector device according to another exemplary embodiment of the invention differs from the plug connector semifinished product 500 according to FIG. 5 substantially only by the embodiment of the plug-in elements. In the plug connector semifinished product 600, two different types of plug-in elements are provided and will be described below in greater detail.

Figure 7:
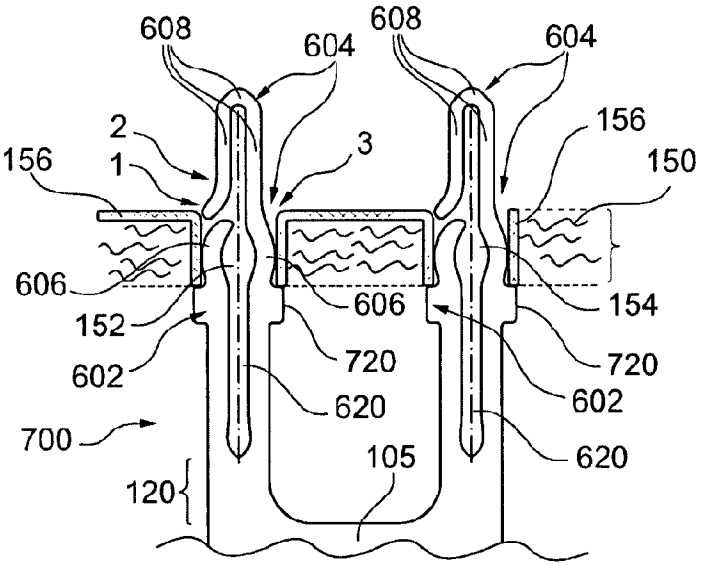
FIG. 7 shows a plug connector device in accordance with an exemplary embodiment of the invention, which is based on the plug connector semifinished product shown in FIG. 6, is inserted into a printed circuit board, and together therewith forms a connection assembly.

FIG. 7 shows the result once the plug connector semifinished product 600 folded or bent along the bending lines 502, 504 and 506 (in accordance with the description of FIG. 1 to FIG. 5) has been bent into a plug connector device 700 according to an exemplary embodiment, wherein, in FIG. 7, the state in which this plug connector device 700 is inserted into a printed circuit board 150 is already shown. As in FIG. 1, the contactings 156 are also provided continuously in FIG. 7, such that a common conductive region of the printed circuit board is contacted ohmically with the plug connector device 700 by the contactings 156.

Figure 3:
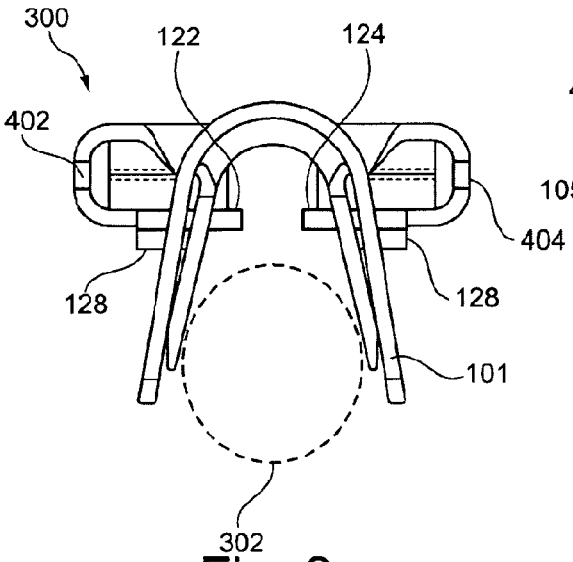
FIG. 3 shows a plan view of the plug connector device according to FIG. 1.

The plug connector device 700 is designed for electrical connection of a conductor, which can be engaged by crimped tabs 601 (as shown in FIG. 3), with the printed circuit board 150 shown in cross section.

The plug-in elements 602, 604 of the plug connector device 700 will be described in greater detail hereinafter. The plug connector device 700 has four pairs of plug-in elements 602, 604 (see FIG. 6). The total of eight plug-in elements 602, 604 are inserted jointly into the two contact holes 152, 154 in the printed circuit board 150 after a corresponding bending of the plug connector semifinished product 600 and, in so doing, are compressed resiliently in the direction of a respective central axis 620. When plug-in portions 606 of the plug-in elements 602, 604 contact an electrically conductive contacting 156 on the contact holes 152, 154 in the printed circuit board 150, the plug-in portions 606 press the plug-in portions 606 outwardly and thus produce an electrically conductive connection between the plug-in portions 606 and the electrically conductive contact 156 with exertion of a spring force. If one end of the plug-in elements 604 exits from the respective contact hole 152, 154 and therefore from the printed circuit board 150, the plug-in elements 604 are therefore no longer compressed and relaxed by a movement outwardly. A locking effect is thus produced.

More specifically, one of the plug-in elements 604 itself has an underlying locking mechanism. This is based on the fact that, as part of the plug connector device 700 is passed through the contact holes 152, 154 for the purpose of fastening the plug connector device 700 to the printed circuit board 150, the plug connector device 700 is locked to the printed circuit board 150 by resilient barbs. The locking mechanism is unlocked by pressing the plug-in elements 604 together again and subsequently removing the plug connector device 700 from the contact holes 152, 154 in the printed circuit board 602. A reversible locking logic that can therefore be used any number of times is thus created.

A first of the plug-in elements 602 consists of a convex plug-in portion 606, which is located within the respective contact hole 152, 154 and is in direct contact with the electrically conductive contacting 156 when the plug-in elements 602, 604 are inserted into the respective contact hole 152, 154. A second of the plug-in elements 604 has a plug-in portion 606, which also extends from the main body 105, similarly to the plug-in portion 606 of the first plug-in element 602. The plug-in portion 606 of the second plug-in element 604 is also located within the respective contact hole 152, 154 when the plug-in elements 602, 604 are inserted in the respective contact hole 152, 154. The second plug-in element 604 also comprises an arc-shaped portion 608, which, from the plug-in portion 606, extends a short distance through the respective contact hole 152, 154 back to the plug-in portion 606 of the respective plug-in 602 and is separated therefrom by a narrow gap of variable size. If the plug-in elements 604 are pressed together laterally as a result of insertion into the respective contact hole 152, 154, the size of the gap thus also reduces. If the plug-in elements 604 spring back after insertion of the plug connector device 700 into the printed circuit board 150, the size of the gap thus increases again until the resilient system is again in a force-free state. The size of the gap thus reduces initially during the process of inserting the plug connector device 700 into the printed circuit board 150, and enlarges again once the bent portion 608 exits from the printed circuit board 150. This causes the reversible locking. As can be seen, the locking mechanism is formed by a barb, which is formed on a point of the substantially pear-shaped structure formed from the plug-in elements 602, 604, at which point the contiguous structure formed from the plug-in elements 602, 604 is interrupted by a gap 800 (see FIG. 8).

The position of the plug connector device 700 relative to the printed circuit board 150 can be defined for example via a stop region 720. The stop region 720 may, for example, be a protrusion which extends parallel to a surface of the printed circuit board 150, starting from a respective one of the plug-in elements 602, 604. The diameter of the region of the plug connector device 700 at which the stop region 720 is defined is thus increased, such that this region with the stop region 720 no longer passes through the respective contact hole 152, 154, and further movement can thus be prevented.

Figure 8:
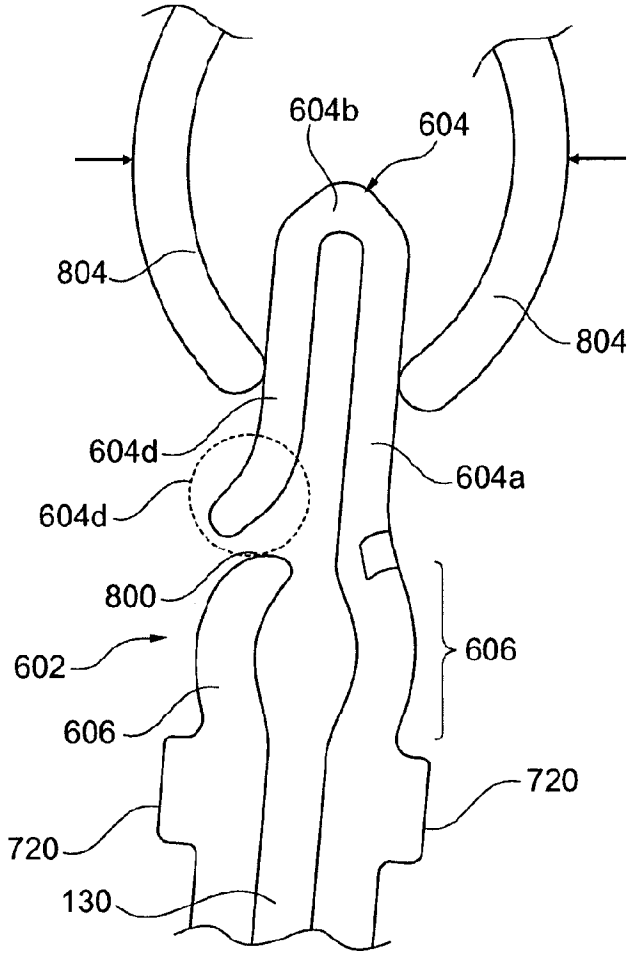
FIG. 8 shows a detailed view of a plug connector device according to FIG. 7.

FIG. 8 shows an enlarged illustration of part of the plug connector device 700 and an associated form tool 804. A freely moveable and rounded end region 604*d* of the arc-shaped portion 608 can be compressed resiliently as the plug connector device 700 is plugged into the printed circuit board 150, and can be passed through the respective contact hole 152, 154 and springs outwardly again once passed through the respective contact hole 152, 154, whereby the plug connector device 700 is locked automatically to the printed circuit board 150 by the end region 604*d*. The rounded end region 604*d* of the arc-shaped portion 608 forms a concave region, which is adjacent to the convex plug-in portion 606 of the first of the plug-in elements 602.

The arc-shaped portion 608 further contains two mutually opposed elongate regions 604*a*, 604*c*, which run parallel to one another and are interconnected by an arc 604*b*, which is arranged opposite the plug-in portions 606 of the first and of the second of the plug-in elements 602, 604, distanced by the elongate regions 604*a*, 604*c*.

As is shown in FIG. 6 and FIG. 7, a total of four pairs of plug-in elements 602, 604 are provided. In the folded state of the plug connector semifinished product 600, as is shown in FIG. 7, these are arranged relative to one another in such a way that the locking mechanism, once the plug connector device 700 has been plugged into the printed circuit board 150, forms two barbs on two mutually opposed regions of the contact hole 152 and on two mutually opposed regions of the contact hole 154, said barbs symmetrically preventing a removal of the plug connector device 700 from the printed circuit board 150. A further plug-in element 602 per contact hole 152, 154 corresponds in terms of structure to the described plug-in elements 602 (not shown in FIG. 7 since it is arranged behind the plug-in elements 604 shown to the front). A further plug-in element 604 per contact hole 152, 154 corresponds in terms of structure to the described plug-in element 604 (only shown in part in FIG. 7 since it is arranged in part behind the plug-in elements 602, 604 shown to the front).

The plug-in elements 604, 604 provided per contact hole 152, 154 are mutually opposed in an axially symmetrical manner. The corresponding axis of symmetry corresponds to the centre axis 620 shown in FIG. 7. Accordingly, the plug-in elements 602, 602 provided per contact hole 152, 154 are mutually opposed in an axially symmetrical manner, wherein the corresponding axis of symmetry corresponds to the centre axis 620 shown in FIG. 7.

The plug-in elements 602, 604 abut against one another with contact and are thus arranged one over the other congruently in part.

As can be seen in FIG. 7, movable limbs that can move outwardly (see position 1) as the plug connector device 700 is plugged into the contact holes 152, 154 of the printed circuit board 150 can be obtained by folding the plug connector semifinished product 600. The detent hook 604*c*, 604*d* of the arc-shaped portion 608 has resilient properties and latches on the printed circuit board 150 (see position 2) once fitted correctly. The bore edge of the printed circuit board 150 can be identified as position 3.

Figure 9:
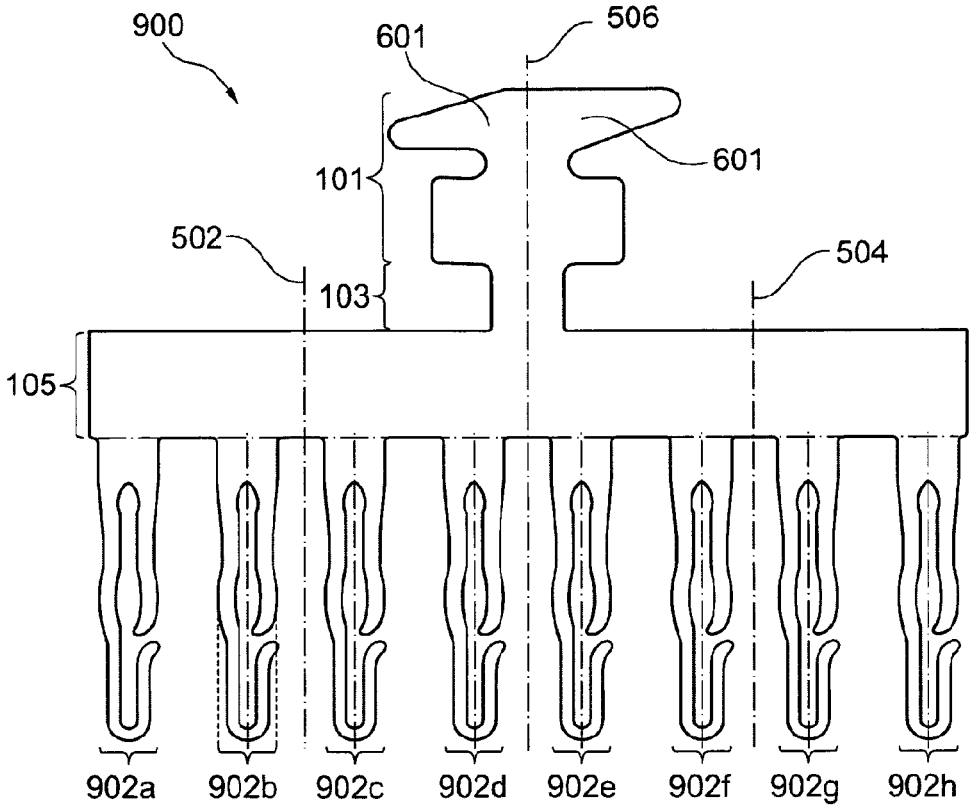
FIG. 9 shows a plug connector semifinished product in accordance with another exemplary embodiment of the invention.

A plug connector semifinished product 900 shown in FIG. 9 according to another exemplary embodiment of the invention corresponds to that of FIG. 6 with the difference that, in accordance with FIG. 9, eight instead of four plug-in element pairs 902*a* to 902*h* are provided. The function of each of the double plug-in elements 902*a* to 902*h* corresponds to a combination of a plug-in element 602 and a plug-in element 604, as has been explained above with reference to FIG. 6 to FIG. 8. Again, three bending lines 502, 504 and 506 are also provided in this exemplary embodiment, specifically two plug-in element overlap bending lines 502, 504 and one conductor fastening bending line 506. The difference compared to FIG. 6 lies in the fact that, in accordance with FIG. 9, the first double plug-in element 902*a* is brought partially into congruence with the fourth double plug-in element 902*d* by bending about the bending line 502, and, simultaneously, the second double plug-in element 902*b* is brought partly into congruence with the third double plug-in element 902*c*. Similarly, a partial congruence between the fifth double plug-in element 902*e* and the eighth double plug-in element 902*h* and also between the sixth double plug-in element 902*f* and the seventh double plug-in element 902*g* can be produced by bending about the line 504. In accordance with FIG. 9, a plug connector device for plugging into four contact holes is thus formed, wherein four plug-in elements or two double plug-in elements dip into each of the contact holes.

Figure 10:
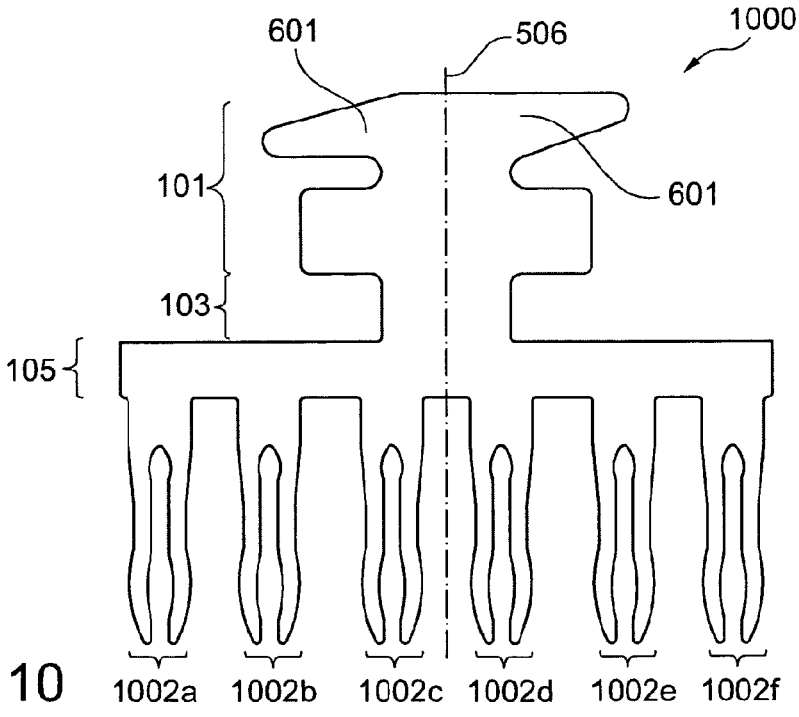
FIG. 10 shows a further plug connector semifinished product for producing another plug connector device according to an exemplary embodiment of the invention.
Figure 12:
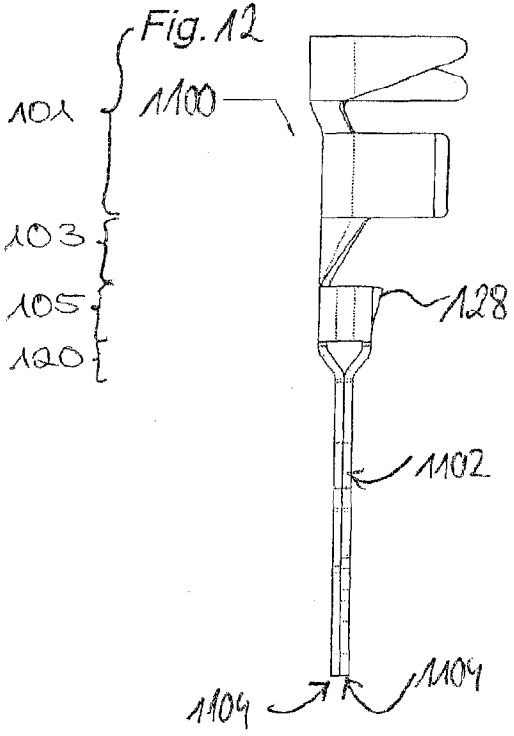
FIG. 12 shows a side view of the plug connector device according to FIG. 11.

FIG. 10 shows a plug connector semifinished product 1000 according to another exemplary embodiment of the invention, which corresponds to the plug connector semifinished 500 shown in FIG. 5 with the difference that, according to FIG. 10, six double plug-in elements 1002*a* to 1002*f* are provided, in contrast to four double plug-in elements 102*b*+102*a*, 102*c*+102*d*, 102*g*+102*h*, 102*f*+102*e* according to FIG. 5. In the exemplary embodiment shown in FIG. 10, bending about a single bending line 506 is sufficient, whereby the first double plug-in element 1002*a* is also brought into complete congruence with the sixth double plug-in element 1002*f*, the second double plug-in element 1002*b* is brought into complete congruence with the fifth double plug-in element 1002*e*, and the third double plug-in element 1002*c* is brought into complete congruence with the forth double plug-in element 1002*d*.

FIG. 9 and FIG. 10 show that the provision of a total of eight plug-in elements, as in FIG. 5, is merely exemplary, and that, in particular, any multiple of four plug-in elements (sixteen in FIG. 9 or twelve in FIG. 10) is possible.

Figure 11:
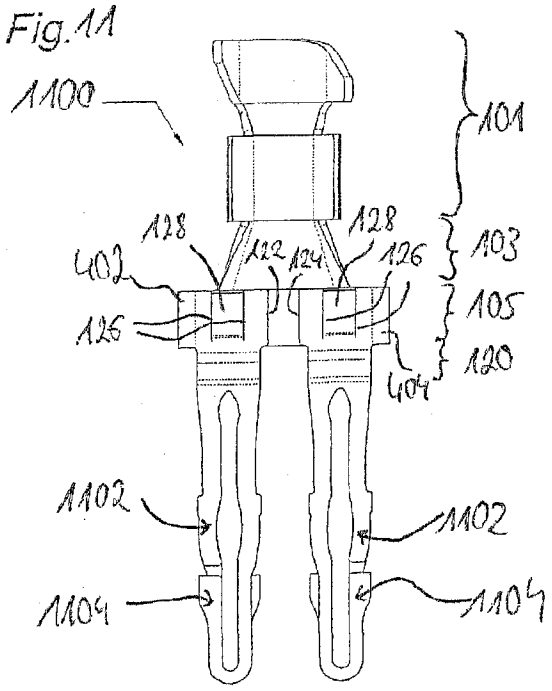
FIG. 11 shows a plug connector device according to another exemplary embodiment of the invention, which can be inserted into a printed circuit board in a manner corresponding to FIG. 1 and together therewith can form a connection assembly.
Figure 13:
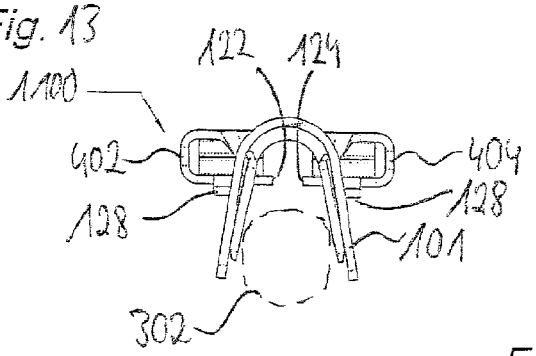
FIG. 13 shows a plan view of the plug connector device according to FIG. 11.
Figure 14:
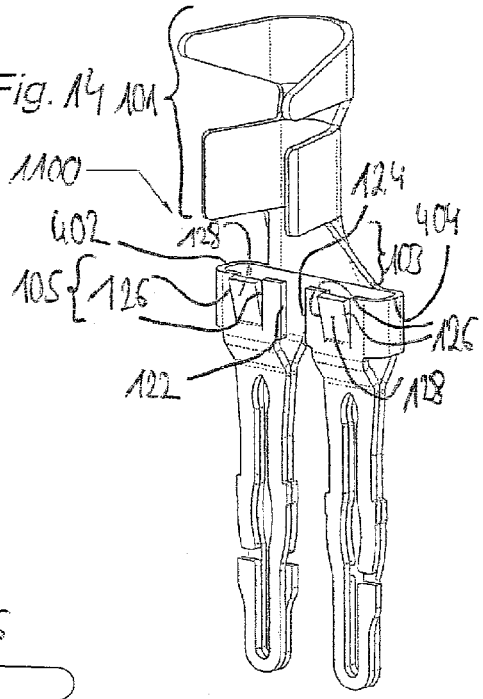
FIG. 14 shows a three-dimensional view of the plug connector device according to FIG. 11.
Figure 15:
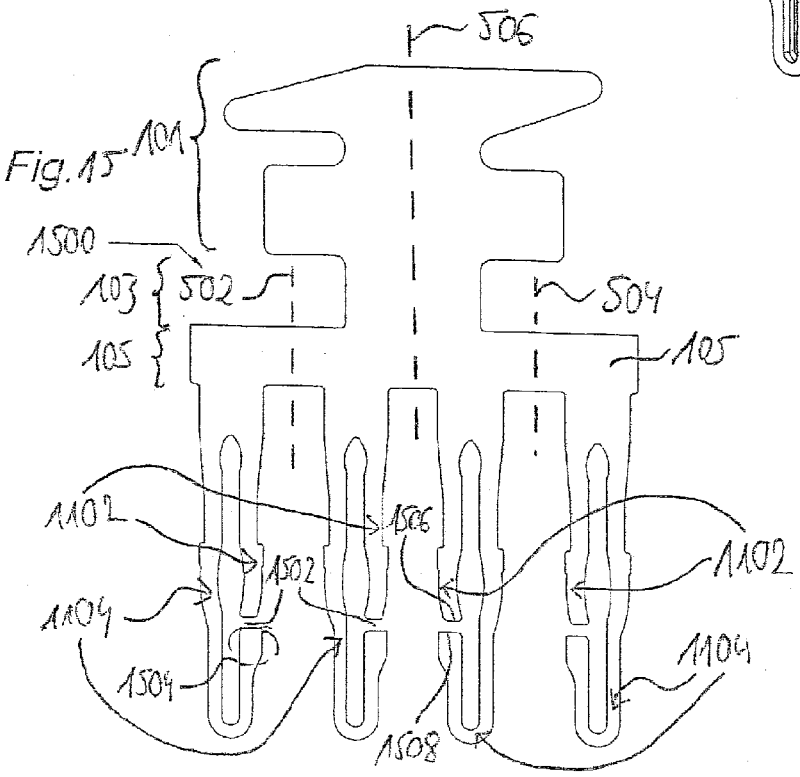
FIG. 15 shows a plug connector semifinished product according to an exemplary embodiment of the invention, which, by bending about bending lines shown in FIG. 15, can be used to form a plug connector device according to FIG. 11.

FIG. 11 to FIG. 4 show views of a plug connector device 1100 according to another exemplary embodiment of the invention, which corresponds largely to that from FIG. 1 to FIG. 4. FIG. 15 shows a corresponding semifinished product 1500. However, the plug connector device 1100 comprises plug-in elements 1102, 1104 that are designed slightly differently compared to the plug connector device 100 and the plug connector device 600.

The plug-in elements 1102 consist of the plug-in portion located within the respective contact hole 152, 154 when the respective plug-in elements 1102, 1104 are inserted in the respective contact hole 152, 154. The plug-in elements 1104 comprise the plug-in portion located within the respective contact hole 152, 154 when the plug-in elements 1102, 1104 are inserted into the respective contact hole 152, 154, and comprise an arc-shaped portion, which, from the plug-in portion, extends through the respective contact hole 152, 154 and back to the plug-in portion of the first of the respective plug-in elements 1302 and is separated therefrom by a purely vertical gap 1502, which then also keeps the respective plug-in elements 1102, 1104 distanced when one or both of the plug-in elements 1102, 1104 is or are compressed laterally during insertion into the respective contact hole 152, 154. A free end portion 1504 of the plug-in element 1104 is not curved. This may act as a barb. A flat end face 1506 of the plug-in element 1102 is arranged opposite, in particular in a substantially parallel manner, a flat end face 1508 of the plug-in element 1104, separated vertically by the vertical gap 1502.

In addition, it should be noted that the term "comprising" does not rule out any other elements or steps and "one" or "a" does not rule out a plurality. Furthermore, it is noted that features or steps that have been described with reference to one of the above exemplary embodiments can also be used in combination with other features or steps of other above-described exemplary embodiments. Reference signs in the claims are not to be considered as limiting.

The invention claimed is:

1. A plug connector device for electrically connecting a conductor to a printed circuit board by direct plugging of the plug connector device into a first contact hole and into a second contact hole of the printed circuit board, wherein the plug connector device comprises:

a fastening region for fastening the conductor to the plug connector device, a transmission region for transmitting a current from the conductor to the printed circuit board, four first plug-in elements, which can be inserted jointly into the first contact hole, and four second plug-in elements, which can be inserted jointly into the second contact hole, wherein each of the plug-in elements extends from a common main body of the plug connector device and runs in a manner separated from the other plug-in elements, wherein the main body with the plug-in elements is formed from a plastically bendable electrically conductive plate, which is bent such that two of the first plug-in elements are arranged opposite two other of the first plug-in elements at least partly congruently for plugging into the first contact hole, and such that two of the second plug-in elements are arranged opposite two other of the second plug-in elements at least partly congruently for plugging into the second contact hole.

2. The plug connector device according to claim 1, wherein bending lines, along which the plate is bent, are aligned parallel to a direction of the extension of the plug-in elements, starting from the main body.

3. The plug connector device according to claim 1, wherein the plate is bent along two bending lines, which run parallel to one another and are each offset laterally with respect to a centre of gravity of the fastening region, wherein the centre of gravity is arranged between the two bending lines.

4. The plug connector device according to claim 1, wherein the plate is bent along at least one first bending line, whereby the plug-in elements are arranged opposite one another, at least partly congruently, wherein the plate is bent along a second bending line, whereby a receiving space for fastening the conductor, in particular in a clamping manner, is formed in the fastening region, wherein the least one first bending line is laterally offset, in particular offset in parallel, with respect to the second bending line.

5. The plug connector device according to claim 1, wherein at least one clamping strip for clamping the plug connector device in a housing is formed as part of the plate by forming at least two recess lines in the plate.

6. The plug connector device according to claim 1, wherein the plate is bent such that the two of the first plug-in elements are arranged opposite and contact, in particular in pairs, the two other of the first plug-in elements, and such that the two of the second plug-in elements are arranged opposite and contact the two other of the second plug-in elements.

7. The plug connector device according to claim 1, comprising an integer multiple of two plug-in elements, in particular an integer multiple of four plug-in elements, more particularly exactly eight plug-in elements.

8. The plug connector device according to claim 1, wherein the four plug-in elements to be inserted into a respective contact hole are formed as two identical pairs, in particular as two pairs having plug-in elements arranged axially symmetrically to one another.

9. The plug connector device according to claim 1, wherein a first of the first and a first of the second plug-in elements consists of the plug-in portion located within the respective contact hole when the respective plug-in elements are inserted in the respective contact hole:

wherein a second of the first and a second of the second plug-in elements comprises the plug-in portion located within the respective contact hole when the plug-in elements are inserted in the respective contact hole and comprises an arc-shaped portion, which, from the plug-in portion, extends through the respective contact hole and back to the plug-in portion of the first of the respective plug-in elements and is separated therefrom by a gap.

10. The plug connector device according to claim 1, wherein a first of the first and a first of the second plug-in elements consists of the plug-in portion located within the respective contact hole when the respective plug-in elements are inserted in the respective contact hole;

wherein a second of the first and a second of the second plug-in elements comprises the plug-in portion located within the respective contact hole when the plug-in elements are inserted in the respective contact hole and comprises an arc-shaped portion which, from the plug-in portion, extends through the respective contact hole and back to the plug-in portion of the first of the respective plug-in elements and is separated therefrom by a gap, which then also keeps the respective plug-in elements spaced when one or both of the plug-in elements is or are laterally compressed during insertion into the respective contact hole.

11. A plug connector semifinished product formed from a bendable plate for producing a plug connector device according to claim 1, wherein the plug connector semifinished product can be bent along at least one bending line, in particular along at least two bending lines, such that the plug connector device according to claim 1 can be produced by bending the plug connector semifinished product.

12. A vehicle comprising a plug connector device according to claim 1.

13. A method of using a plug connector device according to claim 1 for transmitting an electric current of at least 5 amps, in particular of at least 10 amps, more particularly at least 20 amps, between the plug-in elements of the plug connector device and the printed circuit board fastened thereto.

14. The plug connector device (100) according claim 1, wherein each of the plug-in elements comprises a plug-in portion, wherein the plug-in portion is the portion of the plug-in elements located within the respective contact hole when the plug-in elements are inserted in the respective contact hole, wherein the plug-in elements are elastically deformable with respect to the main body independently to one another and are designed in such a way that, when the plug-in elements are inserted in the contact hole, a plug connection can be provided between the plug connector device and the printed circuit board.

15. The plug connector device according to claim 14, wherein the plug-in portion comprises at least one convex surface.

16. The plug connector device according to claim 1, wherein at least one of the first and/or at least one of the second plug-in elements each comprises a locking mechanism, in particular a barb locking mechanism, which is designed, as the plug connector device is guided through the respective contact hole, to lock the plug connector device on the printed circuit board.

17. The plug connector device according to claim 16, wherein the locking mechanism is designed, when the plug-in elements are pressed together and the plug connector device is removed from the contact holes, to unlock the plug connector device again from the printed circuit board.

18. A connection assembly, comprising a plug connector device according to claim 1, and a printed circuit board having the first contact hole and having the second contact hole, wherein the plug connector device is connected to the printed circuit board by a plug connection.

19. The connection assembly according to claim 18, wherein the printed circuit board is provided with a first electrically conductive contacting layer in the first contact hole and with a second electrically conductive contacting layer in the second contact hole, wherein the first electrically conductive contacting layer and the second electrically conductive contacting layer are formed as a contiguous electrically conductive structure.

20. The plug connector device according to claim 1, wherein a first end region of the plate is bent in a U-shaped manner, whereby the two of the first plug-in elements are arranged opposite the two other first plug-in elements, and wherein a second end region of the plate is bent in a U-shaped manner, whereby the two of the second plug-in elements are arranged opposite the two other second plug-in elements.

21. The plug connector device according to claim 20, wherein end faces of the two bent-over end regions of the plate are spaced from one another and are arranged opposite one another, aligned to flush with one another.

22. The plug connector device according to claim 21, wherein a clamping strip is formed on each of the two bent-over end regions of the plate, such that the two clamping strips protrude from the plate along the same direction.

23. The plug connector device according to claim 1, wherein the fastening region is formed as a crimpable portion.

24. The plug connector device according to claim 23, wherein the crimpable portion and the plug-in elements are formed from different materials.

25. The plug connector device according to claim 23, wherein the crimpable portion is formed with a thinner material thickness than the sum of the thicknesses of the two plug-in elements arranged opposite one another at least partly congruently.

26. The plug connector device according to claim 25, wherein the plate, in the crimpable portion, has a thickness in a range between 0.1 mm and 0.7 mm, in particular a thickness in a range between 0.3 mm and 0.5 mm.

27. The plug connector device according to claim 25, wherein the plug-in elements arranged opposite one another at least partly congruently jointly have a thickness in a range between 0.5 mm and 1.1 mm, in particular a thickness in a range between 0.7 mm and 0.9 mm.

28. A method of electrically connecting a conductor to a printed circuit board by direct plugging of a plug connector device simultaneously into a first contact hole and into a second contact hole of the printed circuit board, wherein the method comprises:

bending an electrically conductive plate of the plug connector device in such a way that two of four first plug-in elements of the plug connector device are arranged opposite two other of the first plug-in elements at least partly congruently for plugging into the first contact hole, and in such a way that two of four second plug-in elements of the plug connector device are arranged opposite two other of the second plug-in elements at least partly congruently for plugging into the second contact hole, fastening the conductor to a fastening region of the plug connector device, jointly inserting the four first plug-in elements of the plug connector device into the first contact hole and the four second plug-in elements of the plug connector device into the second contact hole so as to form a plug connection between the plug connector device and the printed circuit board, transmitting a current from the conductor to the printed circuit board via a transmission region of the plug connector device.

* * * * *